United States Patent [19]

Dekker

[11] Patent Number: 4,465,110

[45] Date of Patent: Aug. 14, 1984

[54] JET WEAVING MACHINE

[75] Inventor: Martinus Dekker, Deurne, Netherlands

[73] Assignee: Rüti-te Strake, B.V., Netherlands

[21] Appl. No.: 339,084

[22] Filed: Jan. 13, 1982

[30] Foreign Application Priority Data

Jan. 13, 1981 [CH] Switzerland ..... 197/81

[51] Int. Cl.[3] ..... D03D 51/34

[52] U.S. Cl. ..... 139/370.2; 139/194

[58] Field of Search ..... 139/336 R, 370.1, 370.2, 139/194; 66/163

[56] References Cited

U.S. PATENT DOCUMENTS

| | | | |
|---|---|---|---|
| 3,532,138 | 10/1970 | Schlappi | 139/370.2 |
| 3,744,533 | 7/1973 | Yano et al. | 139/370.2 |
| 3,821,972 | 7/1974 | Svaty et al. | 139/370.2 |
| 3,880,198 | 4/1975 | Vermeulen | 139/370.2 |
| 4,270,579 | 6/1981 | Nakanishi | 139/370.2 |

*Primary Examiner*—Henry Jaudon

*Attorney, Agent, or Firm*—Burns, Doane, Swecker & Mathis

[57] ABSTRACT

A jet weaving machine is provided with an inserting nozzle at one end of the shed, a guide channel (7) comprised of lamellae (3) (e.g., the reed dents) arranged over the width of the warp shed, for guiding the weft thread during insertion in the shed, a first weft thread monitor (8) disposed in the region of the far end of the shed for emitting a signal when the inserted weft thread has not reached its intended length, and a tensioning device (9) located beyond the first weft thread monitor (8) in the direction of weft insertion (A), for stretching, straightening, and holding (taut) the inserted weft thread until beating-up is performed. The tensioning device (9) is in the form of an element through which an auxiliary fluid flows to take the head of the inserted weft thread which projects out of the shed and bend it transversely away from the weft insertion direction (A). A second weft thread monitor (15) is disposed downstream with respect to the flow of the auxiliary fluid of the tensioning device (9) and emits a signal if the inserted weft thread overshoots its intended length by a prescribed distance. In this way, weaving machines of this type are provided with means of detecting weft defects associated with so-called "overshoots" which arise, for example, from breaking of the weft thread during insertion in the shed.

6 Claims, 1 Drawing Figure

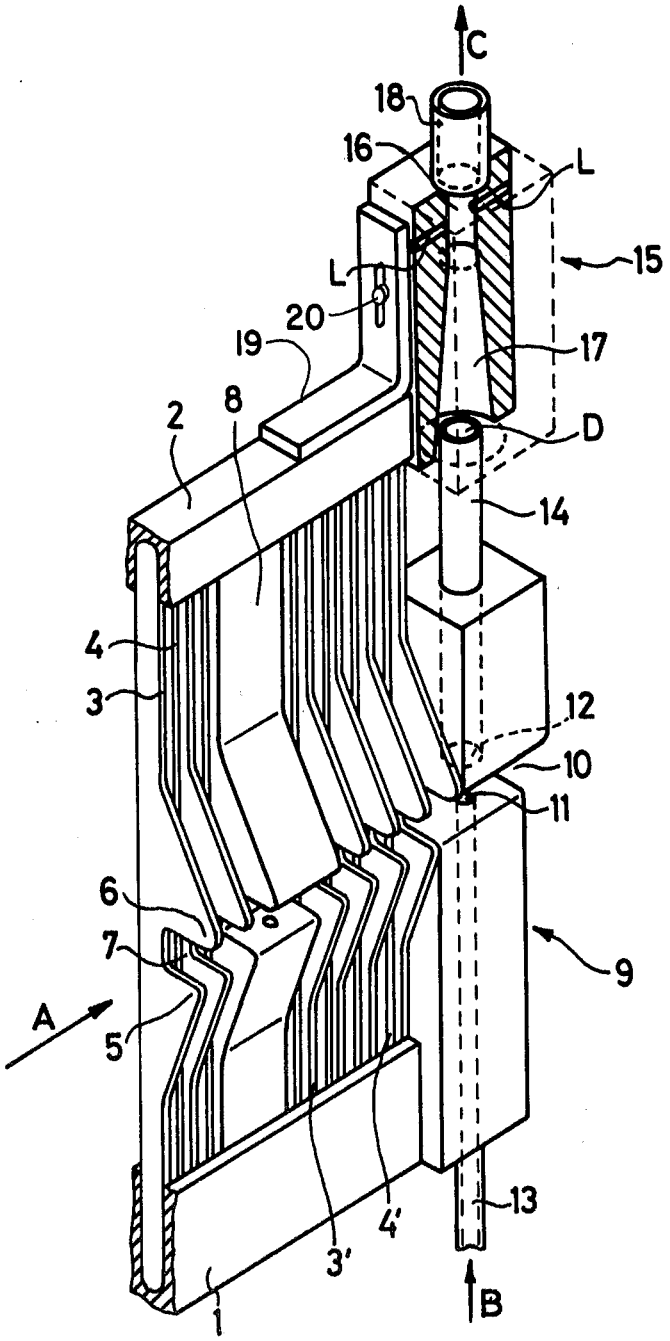
C
18
16
L
15
L
20
19
17
2
8
D
14
4
3
12
10
11
6
7
9
A
5
13
4'
3'
B
1

JET WEAVING MACHINE

BACKGROUND AND SUMMARY OF THE PRESENT INVENTION

This invention relates to a jet weaving machine which includes an inserting nozzle at one end of the shed, a guide channel comprised of lamellae (e.g., the reed dents) arranged over the width of the warp shed, for guiding the weft thread during insertion in the shed, a first weft thread monitor disposed in the region of the far end of the shed for emitting a signal when the inserted weft thread has not reached its intended length, and a tensioning device located beyond the first weft thread monitor in the direction of the weft insertion, for stretching and holding the inserted weft thread until beating-up is performed, said tensioning device being in the form of an element through which an auxiliary fluid flows to take the head of the inserted weft thread which projects out of the shed and bend it transversely away from the weft insertion direction.

In these and other weaving machines the weft thread is susceptible to breakage during its insertion in the shed. Instances of this are known as "bursting the weft". These may not be recognized as weft defects by the first weft thread monitor, since the arrival of the broken forward part of the weft thread at the first weft thread monitor is interpreted by the monitor as correct weft insertion.

In West German Offenlegungsschrift No. 25 17 471, in connection with a gripper weaving machine a weft thread monitoring device is described with which "bursting of the weft" or so-called "overshoot" can also be recognized. This device has a second weft thread monitor at a distance from the first weft thread monitor and aligned with it. The second weft thread monitor emits a signal if the inserted weft thread overshoots its intended length by a prescribed distance.

It would be desirable to be able to equip a jet weaving machine of the type described initially above with a second weft thread monitor. However, thus far this has not been considered feasible, because, in the first place, the leading end of the inserted weft thread is always engaged in i.e., passes all the way to the tensioning device, hence the second weft thread monitor may not be disposed ahead of the tensioning device; and in the second place, the leading end of the weft thread does not fly through the tensioning device in the shooting direction, regardless of whether there is "bursting of the weft", hence for this reason the second weft thread monitor cannot be disposed in alignment with the first weft thread monitor, but may be disposed, apparently, beyond the tensioning device.

The underlying object of the present invention is to devise a jet weaving machine of the type described initially above, wherein either "overshoot" or "bursting of the weft" will be recognized as a weft defect.

This object is achieved according to the invention by a second weft thread monitor disposed in the region of the exit end of the auxiliary fluid flow from the tensioning device, whereby said second monitor emits a signal if the inserted weft thread overshoots its intended length by a prescribed amount.

The invention will be described in more detail hereinafter with reference to an exemplary embodiment shown in the accompanying drawing.

DETAILED DESCRIPTION OF THE PREFERRED EMBODIMENT

The weft thread exit end of a reed for an air jet weaving machine is shown in the drawing. This comprises a lower and an upper frame channel (1 and 2, respectively), and further comprises reed dents 3 and 4 which are profiled and straight, respectively, and are held at their ends in the frame channels. The profiled lamellar reed dents 3 each have two nose-shaped projections 5 and 6 which are separated by a recess. The recesses in all the profiled reed dents 3 are aligned with each other, and form a half-open guide channel 7 for the weft threads, which channel extends over the width of the warp. In the illustrated embodiment, between each pair of profiled reed dents 3 there is a straight reed dent 4 having its front edge flush with the bottom of the guide channel 7.

It is not crucial to the invention to have the straight reed dents 4, but it is understood that there could well be no straight reed dents 4, or more than one such reed dent, between each pair of profiled reed dents 3. Furthermore, it is not necessary for the distribution of profiled and straight reed dents 3 and 4, respectively, to be uniform over the width of the warp.

The weft is inserted with the aid of a main nozzle which is disposed on the weft-thread-entry side of the warp threads, along with auxiliary nozzles which extend closer to the guide channel 7, are operated synchronously with the reed, and periodically move into and out of the shed lit., "the warp threads". The result is that the weft thread is inserted via these nozzles in the direction of arrow A through the guide channel 7 and thus into the shed. The use of the various nozzles and their placement are assumed to be known, and therefore the nozzles are not shown in the drawing; in this connection, reference may be made to U.S. Pat. No. 3,818,952.

The far left weft reed dents 3 and 4 in the drawing are located in the weft-thread-exit-side selvedge area of the fabric, and the selvedge warp threads are carried in the weaving machine between these reed dents. There is a first weft thread monitor 8 adjoining these reed dents in the weft insertion direction A. This monitor is of the optical electronic type, and has a shape which matches that of the profiled lamellar reed dents.

The first weft thread monitor 8 serves to monitor whether the inserted weft thread has reached its intended length or is too short. If there is a so-called "short shot", the weft thread does not pass the first weft thread monitor 8, and the monitor emits a signal by which the weaving machine is stopped.

Beyond the first weft thread monitor 8 in the weft insertion direction A, the reed dents 3' and 4' are mounted in the frame channels 1 and 2. The warp threads for an auxiliary selvedge are carried between these dents. However, if an auxiliary selvedge is not required, then reed dents 3' and 4' need not be present, in which case the reed could end at the exit of the weft threads from the shed through the first weft thread monitor 8.

Immediately beyond the reed in the weft insertion direction A, on the oscillating beam or batten (not shown) which carries the reed, there is disposed a tensioning device 9 for the weft thread. Its function is to engage the leading end of the weft thread as soon as it has flown through the shed, to extend and straighten the weft thread, and to hold it under tension until beating-up is performed. Tensioning device 9 has a half-open recess 10 which is aligned with the guide channel 7. The lower boundary of this recess has an air entry opening 11, and the corresponding upper boundary has an air exit opening 12. The two openings 11 and 12 lie opposite each other, and are connected to an air supply line 13 and an air exhaust line 14, respectively, so that there is an additional flow in the direction of arrows B and C in recess 10, said flow being transverse to the weft insertion direction A. The leading end of the weft thread is deflected from the shooting direction A by this additional flow, and directed into tube section 14, whereby the weft thread is extended, straightened, and placed under tension. The dimensions of tensioning device 9 and the geometry of its positioning are chosen such that the leading end of a properly inserted weft thread will not extend beyond the flow exit end D of tube 14, but will remain within tube section 14.

If, during the insertion of the weft thread in the shed, the weft thread should break, its broken-off leading end will fly further, and will either be blown out of guide channel 7 in direction A, whereupon it will be pulled by suction through tube 14, or else it will catch on the warp threads of the closing shed before the leading end exits from the shed. In the first case, the inserted weft thread will be too short. In the second case, a "weft thread gap" develops. In both chases, the result is a defect in the pattern of the fabric. The first weft thread monitor 8 cannot detect these defects, since its interpretation of the flying-by of the broken-off leading end part of the weft thread is that the weft thread has reached its intended length and thus has been correctly inserted.

In order to recognize these "overshoots" which may arise from so-called "bursting of the weft", a second weft thread monitor 15 is provided which emits a signal which stops the weaving machine when the second monitor detects the passing of a weft thread. The distance between the two weft thread monitors 8 and 15 is selected such that it is ensured that the tip of the weft thread will not reach the second weft thread monitor 15 in the case of correct insertion. Each arrival of a weft thread end at the second weft thread monitor 15 is thus a definite indication of an "overshoot", i.e., an indication of an insertion error. In this connection, reference is also made to West German Offenlegungsschrift No. 25 17 471.

The second weft thread monitor 15, which is shown in cross section in the drawing, is mounted by a bracket 19 on the upper frame channel 2 of the reed in such a way as to be vertically movable and adjustable, for example, with a bolt and slot arrangement 20. It has a bore hole 16 in which a photocell arrangement L is disposed and which has a hornshaped broadening section 17 facing the tensioning device 9. The second weft thread monitor 15 is positioned over the flow exit end D of the air exhaust tube 14 via broadening section 17, and can be shifted vertically to the extent of 30 to 50 mm at most over the flow exit end D of tube 14, for the purpose of adjusting to the length of the leading end section of the weft thread which is held in tube 14.

The hole 16 in the second weft thread monitor 15 opens out into a tube section 18 communicating with a vacuum line (not shown). The leading end section of the weft thread which is severed after the beating-up is performed is exhausted by the vacuum line in the direction of arrow C and transported to a waste container.

The inventive arrangement has been described with reference to an air jet weaving machine; however, it will be obvious to persons skilled in the art that suitable fluids other than air may be used for inserting the weft thread and-or extending, straightening, and placing under tension the weft thread until beating-up is performed.

There are air jet weaving machines in which the first weft thread inserted following the start of the machine invariably overshoots its intended length. In order to prevent the second weft thread monitor 15 from producing a defect signal in this eventuality, one may either choose the distance between the second weft thread monitor 15 and the tensioning device 9 to be great enough so that even these first weft threads do not reach the second weft thread monitor 15, or preferably one can arrange the control electronics of the weaving machine such that the defect signal produced by the first insertion following the starting of the weaving machine is in each case suppressed.

I claim:

1. A jet weaving machine having an inserting nozzle at one end of a shed, a guide channel comprised of lamallae and extending over the width of the warp for guiding a weft thread in the shed during insertion, a first weft thread monitor disposed in the region of a far end of the shed in the direction of weft insertion for emitting a signal when an inserted weft thread has not reached its intended length, and a tensioning device disposed in the weft insertion direction on the downstream side of the first weft thread monitor for stretching, straightening, and holding the inserted weft thread until beating-up is performed, said tensioning device being in the form of an element through which an auxiliary fluid flows, said element taking a leading end of the inserted weft thread which end projects out of the shed and bending the inserted thread away from the weft direction by acting on the thread generally perpendicular to the weft direction, a second weft thread monitor disposed downstream in a direction of flow of the auxiliary fluid of a flow exit end of the tensioning device, said second monitor emitting a signal if the inserted weft thread overshoots its intended length by a prescribed distance, the second weft thread monitor being mounted on a frame channel of the reed dents, and means for adjusting the distance of the second monitor from the flow exit end of the tensioning device.

2. Jet weaving machine according to claim 1, wherein the flow direction of the auxiliary fluid in the tensioning device is parallel to a longitudinal direction of reed dents of the lamallae, the tensioning device being provided with a tube section having a free end which constitutes the exit end of the auxiliary fluid flow path through the tensioning device.

3. Jet weaving machine according to claim 2; wherein the second weft thread monitor has a bore hole in which a photocell system is disposed.

4. Jet weaving machine according to claim 3; wherein said bore hole of the second monitor is aligned with the tube section of the tensioning device.

5. Jet weaving machine according to claim 4; wherein a horn-shaped broadening section adjoins the end of the bore hole of the second weft thread monitor, said broadening section facing the flow exit end of the tensioning device, a free end of said broadening section overlapping an end of the tube section said end forming the flow exit end of the tensioning device.

6. Jet weaving machine according to claim 5; wherein the opposite end of the bore hole in the second weft thread monitor opens out into a vacuum line.

* * * * *